US009428366B2

(12) United States Patent
Asai

(10) Patent No.: US 9,428,366 B2
(45) Date of Patent: Aug. 30, 2016

(54) GRAVITY COMPENSATION DEVICE AND LIFT APPARATUS INCLUDING THE SAME

(71) Applicant: Panasonic Corporation, Osaka (JP)

(72) Inventor: Katsuhiko Asai, Nara (JP)

(73) Assignee: Panasonic Intellectual Property Mangement Co., Ltd., Osaka (JP)

( * ) Notice: Subject to any disclaimer, the term of this patent is extended or adjusted under 35 U.S.C. 154(b) by 709 days.

(21) Appl. No.: 13/785,364

(22) Filed: Mar. 5, 2013

(65) Prior Publication Data

US 2013/0180804 A1 Jul. 18, 2013

Related U.S. Application Data

(63) Continuation of application No. PCT/JP2012/002305, filed on Apr. 3, 2012.

(30) Foreign Application Priority Data

Jun. 2, 2011 (JP) ..... 2011-124307

(51) Int. Cl.
*B66B 17/12* (2006.01)
*B66F 7/02* (2006.01)
(Continued)

(52) U.S. Cl.
CPC ..... *B66B 17/12* (2013.01); *B66F 7/02* (2013.01); *B66F 19/00* (2013.01); *B66B 9/00* (2013.01)

(58) Field of Classification Search
CPC ..... B66F 9/00; B66F 9/02; B66F 7/02; B66F 7/04; B66F 19/00; B66B 17/12; B66B 9/00; B66B 9/02; B65G 9/00
USPC ..... 187/404, 405
IPC ..... A47B 9/10; A47C 17/84
See application file for complete search history.

(56) References Cited

U.S. PATENT DOCUMENTS 3,971,296 A * 7/1976 Tugwell ..... F01B 1/08 91/186
4,651,652 A * 3/1987 Wyckoff ..... A47B 9/12 108/147

(Continued)

FOREIGN PATENT DOCUMENTS

DE 3446408 A1 * 7/1986 ..... A47C 3/30
DE 19626855 A1 * 1/1998 ..... A47B 9/12

(Continued)

OTHER PUBLICATIONS

Translation of International Preliminary Report on Patentability mailed Dec. 12, 2013 in International (PCT) Application No. PCT/JP2012/002305.

(Continued)

*Primary Examiner* — William A Rivera
*Assistant Examiner* — Stefan Kruer
(74) *Attorney, Agent, or Firm* — Wenderoth, Lind & Ponack, L.L.P.

(57) ABSTRACT

A link has first and second ends coupled, so as to be axially shiftable, respectively to two shafts that include a reference point located in a base and cross each other. A gas actuator has an inner space that has gas pressure pressing the first end of the link toward the reference point so as to shift the first end of the link such that a distance between a first end position of the link and the reference point is equal to or more than a distance between the first and second ends in a state where the inner space has a volume equal to zero obtained by extrapolating variation of the inner space volume relative to the first end position. The second end and a lift section that is vertically shiftable with respect to the base are coupled by means of a coupling section.

7 Claims, 10 Drawing Sheets

(51) Int. Cl.
*B66F 19/00* (2006.01)
*B66B 9/00* (2006.01)

(56) References Cited

U.S. PATENT DOCUMENTS 4,850,782 A * 7/1989 Focke ..... B65G 61/00 187/405
5,031,727 A * 7/1991 Clare ..... B66F 7/04 187/203
5,152,375 A * 10/1992 Zellweger ..... B01D 3/08 187/266
5,718,406 A * 2/1998 Long ..... A47B 9/02 108/147
6,012,552 A * 1/2000 Del Rio ..... B66F 9/02 187/262
6,453,793 B1 * 9/2002 Simonds ..... F01B 9/047 91/345
7,748,308 B2 * 7/2010 Anderson ..... B30B 1/18 72/30.1
2008/0277208 A1 * 11/2008 Barone ..... B66F 7/02 187/273

FOREIGN PATENT DOCUMENTS

DE 19648451 A1 * 5/1998 ..... A47B 9/10
JP 2-243500 9/1990
JP 3-80810 4/1991
JP 7-101700 4/1995
JP 3794743 4/2006
JP 3794743 7/2006
JP 4144021 6/2008
JP 4144021 9/2008
JP 2011-43125 3/2011
WO WO 9955197 A1 * 11/1999 ..... A47B 9/10

OTHER PUBLICATIONS

International Search Report issued Jul. 17, 2012 in International (PCT) Application No. PCT/JP2012/002305.

* cited by examiner

GRAVITY COMPENSATION DEVICE AND LIFT APPARATUS INCLUDING THE SAME

CROSS-REFERENCE TO RELATED APPLICATIONS

This is a continuation application of International Application No. PCT/JP2012/002305, with an international filing date of Apr. 3, 2012, which claims priority of Japanese Patent Application No. 2011-124307 filed on Jun. 2, 2011, the content of which is incorporated herein by reference.

TECHNICAL FIELD

The technical field relates to a gravity compensation device that reduces consumption of air with use of a link in an apparatus for compensating for the effects of gravity by means of the pressure of compressed gas. The technical field also relates to a lift apparatus including the gravity compensation device.

BACKGROUND ART

There have been devised measures to compensate for gravity (weight of an object) and reduce a load applied upon vertically shifting the object, in addition to basic measures such as a counter weight and a constant force spring (see JP 3794743 B1 and JP 4144021 B1, for example).

However, in the case of adopting the configuration including, as the measure to compensate for gravity, the counter weight, an elastic member such as the constant force spring or a spring, there is required troublesome work such as replacement of a component or modification of the structure in order to deal with variation of load weight applied by an object. Furthermore, force is applied to the elastic member in a state where load weight is applied, in which case it is more difficult to deal with variation of load weight. In a case of compensating for gravity with use of a pneumatic cylinder, variation of load weight can be easily dealt with by controlling the volume of air in the pneumatic cylinder. However, in a conventional configuration, air needs to be charged or discharged every time displacement occurs, resulting in an increase in consumption of air, which is problematic.

SUMMARY OF THE INVENTION

One non-limiting and exemplary embodiment of the present invention provides a gravity compensation device and a lift apparatus including the gravity compensation device each of which easily deals with variation of load weight and does not need to consume gas upon displacement.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect, the techniques disclosed here feature: a gravity compensation device comprising: a base; a link that has a first end and a second end coupled, so as to be axially shiftable, respectively to two shafts that each include a first reference point located in the base and cross each other at a certain angle; and a gas actuator fixed to the base and including a movable portion that is movable and is connected to the first end of the link so as to press the first end of the link between a first end position and a second end position toward the first reference point with use of pressure of gas in an inner space of a cylinder. When the first end of the link is located at a second reference point on one of the two shafts including the first reference point, the movable portion has a motion range set such that the movable portion is positioned so as to set to zero a volume of the inner space obtained by extrapolating variation of the volume in the inner space and a distance between the first reference point and the second reference point is substantially equal to or more than a distance between the first end and the second end of the link. A lift section vertically shiftable with respect to the base; and a coupling section couples the second end of the link and the lift section so as to associate expansion of the inner space of the gas actuator with upward shift of the lift section. The gravity compensation device compensates for gravity applied to the lift section.

These general and specific aspects may be implemented using a system, a method, and a computer program, and any combination of systems, methods, and computer programs.

According to the aspect, force generated by the gas actuator from internal pressure is transmitted to the lift section by way of the link having the two ends restrained respectively to the two shafts so as to be axially shiftable. Therefore, it is possible to reduce the influence of variation of force generated in accordance with displacement of the gas actuator on force applied to the lift section. In other words, according to the aspect, gravity can be compensated for even when the lift section is displaced while the volume of gas in the gas actuator is kept constant. Therefore, by controlling the volume of gas in the gas actuator, it is possible to easily deal with variation of load weight. Furthermore, there is no need to consume gas upon displacement of the lift section.

BRIEF DESCRIPTION OF DRAWINGS

These and other aspects and features according to the aspect of the present invention are apparent from the following description in connection with embodiments illustrated in the accompanying drawings. In these drawings.

DETAILED DESCRIPTION

Figure 1:
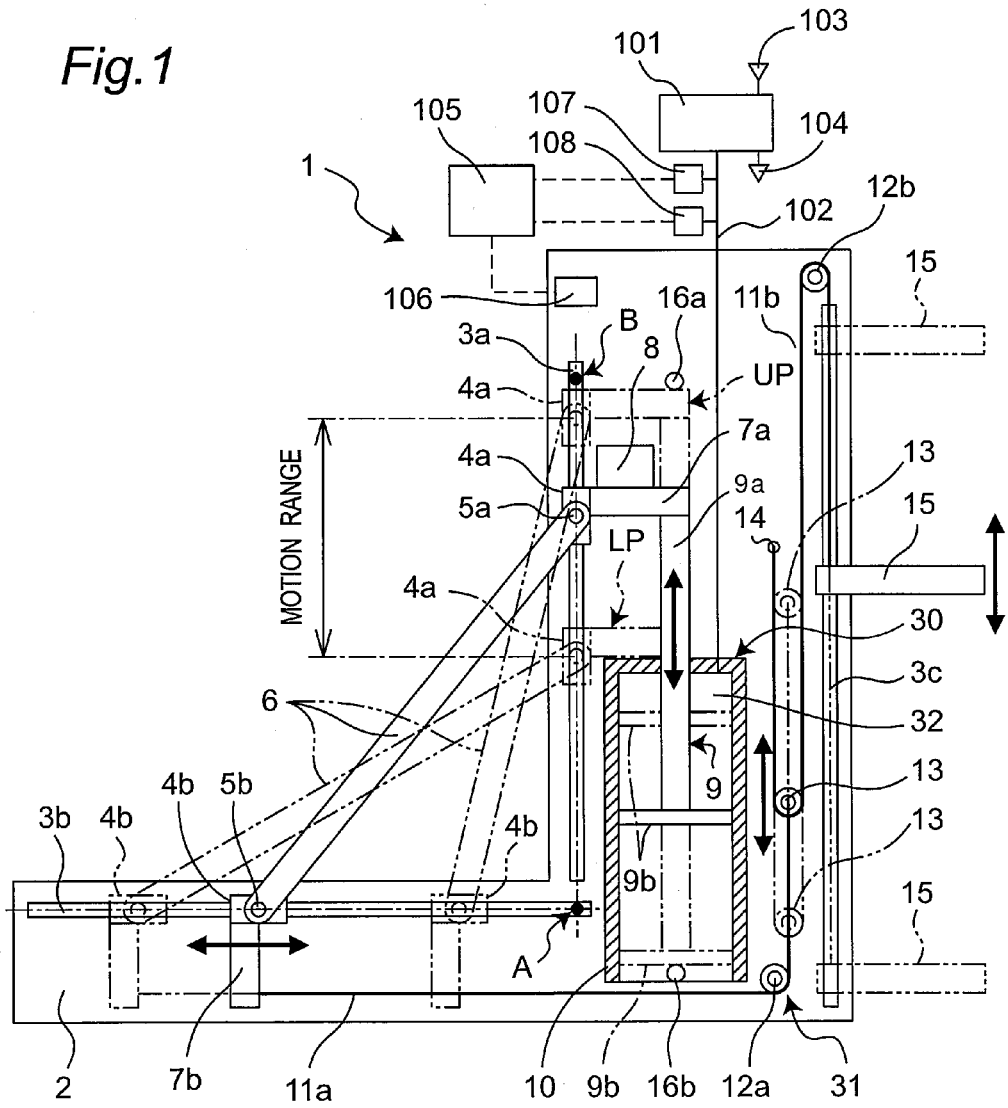
FIG. 1 is a schematic view of a gravity compensation device according to a first embodiment.

Embodiments are detailed below with reference to the drawings.

Prior to the description of the embodiments, first, the basic concept of the present disclosure is explained.

Examples of the disclosed technique are as follows.

A gravity compensation device includes a base; a link that has a first end and a second end coupled, so as to be axially shiftable, respectively to two shafts that each include a first reference point located in the base and cross each other at a certain angle; a gas actuator fixed to the base and including a movable portion that is movable and is connected to the first end of the link so as to press the first end of the link between a first end position and a second end position toward the first reference point with use of pressure of gas in an inner space of a cylinder. When the first end of the link is located at a second reference point on one of the two shafts including the first reference point, the movable portion has a motion range set such that the movable portion is positioned so as to set to zero a volume of the inner space obtained by extrapolating variation of the volume in the inner space and a distance between the first reference point and the second reference point is substantially equal to or more than a distance between the first end and the second end of the link. A lift section is vertically shiftable with respect to the base; and a coupling section couples the second end of the link and the lift section so as to associate expansion of the inner space of the gas actuator with upward shift of the lift section. The gravity compensation device compensates for gravity applied to the lift section.

In such a configuration, force generated by the gas actuator from internal pressure is transmitted to the lift section by way of the link having the two ends restrained respectively to the two shafts so as to be axially shiftable. Therefore, it is possible to reduce the influence of variation of force generated in accordance with displacement of the gas actuator on force applied to the lift section. In other words, according to the first aspect of the present invention, gravity can be compensated even when the lift section is displaced while the volume of gas in the gas actuator is kept constant. Therefore, by controlling the volume of gas in the gas actuator, it is possible to easily deal with variation of load weight. Furthermore, there is no need to consume gas upon displacement of the lift section.

The gravity compensation device according to the first aspect can further include a gas volume controller that controls a gas volume in the gas actuator.

In such a configuration, the volume of gas in the gas actuator can be freely controlled even when the gas actuator is in operation. Therefore, it is possible to deal with variation of load weight more easily.

The gravity compensation device according to the second aspect can further include a gas volume estimator that estimates the gas volume in the gas actuator.

In such a configuration, the volume of gas can be controlled accurately. Therefore, it is possible to deal with variation of load weight more easily.

The gravity compensation device according to any one of the first to third aspects further including an atmospheric pressure compensation portion that compensates for ambient atmospheric pressure applied to the gas actuator and influencing pressing force.

In such a configuration, the influence of the atmospheric pressure can be cancelled. Therefore, gravity can be compensated for with no tolerance even in a case where the gas actuator is operated at low pressure.

In the gravity compensation device according to the fourth aspect, the atmospheric pressure compensation portion can be a weight connected to the movable portion of the gas actuator.

According to such a configuration, the atmospheric pressure can be compensated for in a simple structure.

In the gravity compensation device according to the fourth aspect, the atmospheric pressure compensation portion can be a constant force spring that connects the base and the movable portion of the gas actuator.

According to such a configuration, the atmospheric pressure can be compensated in a simple structure.

In the gravity compensation device according to any one of the first to third aspects, pressure in a space having differential pressure relative to pressure in the inner space of the gas actuator is in proportion to force generated by the gas actuator and can be substantially vacuum pressure.

In such a configuration, the influence of the atmospheric pressure can be cancelled. Therefore, gravity can be compensated with no tolerance even in a case where the gas actuator is operated at low pressure.

In the gravity compensation device according to any one of the first to seventh aspects, the gas actuator can be a mechanism that includes a piston and the cylinder.

In such a configuration, it is possible to easily obtain the relationship between displacement of the gas actuator and internal pressure. As a result, there is achieved the gravity compensation device causing less tolerance.

In the gravity compensation device according to any one of the first to seventh aspects, the gas actuator can be configured by a vane motor and a rack and pinion mechanism combined with the vane motor.

In such a configuration, it is possible to easily obtain the relationship between displacement of the gas actuator and internal pressure. As a result, there is achieved the gravity compensation device causing less tolerance.

A lift apparatus includes: the gravity compensation device according to any one of the first to ninth aspects; and a vertical drive unit for vertically shifting the lift section.

Such a configuration realizes the lift apparatus that includes the gravity compensation device according to any one of the first to ninth aspects. The lift apparatus can achieve the functional effects of the gravity compensation device.

Described below with reference to the drawings are a gravity compensation device according to each of the embodiments of the present invention and a lift apparatus including the same.

First Embodiment

FIG. 1 schematically shows a gravity compensation device 1 according to the first embodiment of the present invention. The gravity compensation device 1 includes a frame 2, a link 6, a gas actuator 30, a lift section 15, and a coupling section 31, so as to compensate for gravity effects applied onto the lift section 15.

In FIG. 1, the frame 2 in the gravity compensation device 1 serves as one example of a base and is bent in an L shape. The gravity compensation device also includes first, second, and third guide rails 3*a*, 3*b*, and 3*c*, which are fixed to the frame 2. The first and second guide rails 3*a* and 3*b* serve as one example of two shafts that are located on an ordinate axis in the vertical direction and on a transverse axis in the horizontal direction, respectively, and are fixed to the frame 2 and cross each other at a predetermined angle. The ordinate axis and the transverse axis include a first reference point A that is located at the bent portion of the frame 2. FIG. 1 serves as one example of a case where the predetermined angle is set to 90 degrees, while the predetermined angle is generally in the range from 70 degrees to 100 degrees. In FIG. 1, the second guide rail 3*b* is extended to the position crossing with the axial direction of the first guide rail 3*a*, and the first reference point A is located on the second guide rail 3*b*.

The third guide rail 3*c* is fixed to the frame 2 so as to be oriented in the vertical direction and parallel to the first guide rail 3*a*.

A first slider 4*a* engages with the first guide rail 3*a*, and a second slider 4*b* engages with the second guide rail 3*b*. Each of the first and second sliders is engaged so as to be axially shiftable and so as not to fall off the respective guide rail. A lift plate 15 engages with the third guide rail 3*c*, and the lift plate 15 serves as one example of the lift section such that the lift plate 15 is axially shiftable and does not fall off the third guide rail 3*c*. The first slider 4*a* is provided with a first pin 5*a*, while the second slider 4*b* is provided with a second pin 5*b*. A rod 6 serves as one example of the link and has two ends rotatably coupled to the first pin 5*a* and the second pin 5*b*, respectively. Vertical shift of the first slider 4*a* in a motion range from a first end position UP to a second end position LP indicated in FIG. 1 is converted to horizontal shift of the second slider 4*b*. The second slider 4*b* has a motion range from the position of the second slider 4*b* on the left end to the position of the second slider 4*b* on the right end, both of which are illustrated with two-dot chain line in FIG. 1.

The gas actuator 30 is oriented in the vertical direction between the first guide rail 3*a* and the third guide rail 3*c* on the frame 2. A piston 9 and a cylinder 10 configure a piston/cylinder mechanism, serving as one example of the gas actuator 30. Air serving as one example of gas is reserved in an inner space 32 located within the upper portion of cylinder, and is surrounded by the piston 9 and inner surfaces of the cylinder 10. The gas has pressure that generates pressing force in the downward direction in FIG. 1. This downward pressing force (which presses a first end (the first pin 5*a*) of the link 6 toward the first reference point A between the first end position UP and the second end position LP) is applied to the piston 9 serving as one example of a movable portion. The piston 9 includes a piston rod 9*a* having an upper (first) end to which a first connecting plate 7*a* is fixed, so that the piston rod 9*a* and the first connecting plate 7*a* are shifted integrally. The first connecting plate 7*a* is fixed also to the first slider 4*a*, so that the first slider 4*a* and the first connecting plate 7*a* are also shifted integrally. Therefore, all the piston rod 9*a*, the first connecting plate 7*a*, and the first slider 4*a* are shifted integrally. A second connecting plate 7*b* is fixed to the second slider 4*b* so as to be shifted integrally with the second slider 4*b*. Driving force applied to the piston 9 is transmitted to the first slider 4*a* by the piston rod 9*a* of the piston 9 and the first connecting plate 7*a*, and is then transmitted to the second connecting plate 7*b* by way of the first pin 5*a*, the rod 6, the second pin 5*b*, and the second slider 4*b*. The cylinder 10 is fixed to the frame 2 at a position where, when the piston 9 is located at an upper limit position, more specifically, when the piston 9 is in contact with the inner surface in the upper portion of the cylinder 10 and the inner space 32 has zero volume, the first pin 5*a* is located at a second reference point B on the first guide rail 3*a* out of the two guide rails 3*a* and 3*b* having the axes including the first reference point A. The distance between the point A and the point B in the axial direction of the first guide rail 3*a* is equal to or more than the distance between the two ends of the rod 6, in other words, the distance between the first pin 5*a* and the second pin 5*b*. FIG. 1 serves as one example of a case where the distance (AB) between the point A and the point B is 1.05 times a distance (DE) between the first pin 5*a* and the second pin 5*b*. For example, the distance (AB) may be generally in the range from 1.0 to 1.05 times in terms of smooth motion. Therefore, the distance AB between the first reference point A and the second reference point B is set to be substantially equal to or more than the distance DE between the first pin 5*a* at the first end of the link 6 and the second pin 5*b* at the second end thereof. The piston 9 has a motion range defined by an upper end stopper pin 16*a* and a lower end stopper pin 16*b*. The upper end stopper pin 16*a* is provided over the piston rod 9*a* and is fixed to the frame 2, while the lower end stopper pin 16*b* is fixed to the cylinder 10. The lower end position LP of the piston 9 is located where a piston plate 9*b* of the piston 9 is in contact with the lower end stopper pin 16*b*. The upper end position UP of the piston 9 is located where the first connecting plate 7*a* provided at the upper end of the piston rod 9*a* is in contact with the upper end stopper pin 16*a*. When the piston 9 is located at the upper end position UP, the first pin 5*a* is located at a position closer to the first reference point A rather than the second reference point B. FIG. 1 serves as one example of the case where the first pin is located at a position closer to the first reference point A rather than second reference point B by 0.13/2.1 times the distance AB.

A weight 8 serving as one example of an atmospheric pressure compensation portion is placed on the first connecting plate 7*a* so as to compensate ambient atmospheric pressure that is applied to the piston 9 and influences pressing force. The mass of the weight 8 is set such that gravity applied to the weight 8 is equal to force obtained by multiplying the absolute pressure of the atmosphere by an area affecting the driving force of the piston 9, more specifically, an area obtained by subtracting the sectional area of the piston rod 9*a* from the area of the piston plate 9*b*. This setting allows the weight having such mass to eliminate the influence of the atmospheric pressure on the driving force of the piston 9. Therefore, the driving force of the piston 9 becomes proportional to the absolute pressure of air reserved in the inner space 32. According to such a configuration, the influence of the atmospheric pressure can be cancelled in a simple structure, with a result that gravity can be compensated for with no tolerance even in a case where the piston is operated at a low pressure.

The second connecting plate 7*b* and the lift plate 15 are coupled each other by a wire and a pulley transmission system that serve as one example of the coupling section 31, so that expansion of the inner space 32 in the gas actuator 30 is associated with upward shift of the lift section 15. The wire and the pulley transmission system 31 include a first wire 11*a*, a second wire 11*b*, a first pulley 12*a*, a second pulley 12*b*, a movable pulley 13, and a fixing pin 14. The first wire 11*a* has a first end fixed to the second connecting plate 7*b*. The first wire 11*a* has a second end fixed to a rotary shaft of the movable pulley 13. The first wire 11*a* between the first and second ends runs by way of the first pulley 12*a* that is rotatably provided near the lower end of the third guide rail 3*c* at the bent portion of the frame 2. In such arrangement, the second connecting plate 7*b* and the movable pulley 13 are connected with each other by the first wire 11*a* such that horizontal displacement of the second connecting plate 7*b* is converted to vertical displacement of the movable pulley 13. The second wire 11*b* has a first end that is fixed to a fixing pin 14 fixed above and near the cylinder 10. The second wire 11*b* has a second end fixed to the lift plate 15. The second wire 11*b* between the first and second ends runs by way of the movable pulley 13 and also by way of the second pulley 12*b* that is rotatably provided near the upper end of the third guide rail 3*c*. In such arrangement, the fixing pin 14 and the lift plate 15 are connected with each other by the second wire 11*b* that runs by way of the movable pulley 13 and the pulley 12*b* fixed to the frame 2. In such a configuration, downward displacement of the movable pulley 13 is doubled and converted to vertically upward displacement of the lift plate 15.

An air volume control valve 101 serves as one example of a gas volume controller. The air volume control valve 101 is connected, by piping 102, to a pressure source 103, an atmosphere releasing outlet 104, and the inner space 32 in the upper portion of the cylinder 10. When the air volume control valve 101 is switched over, compressed air fed from the pressure source 103 is supplied into the inner space 32 in the upper portion of the cylinder 10 through the piping 102, or air in the inner space 32 in the upper portion of the cylinder 10 is discharged from the atmosphere releasing outlet 104 through the piping 102, so as to control the volume of air in the inner space 32 in the upper portion of the cylinder 10. When the air volume control valve 101 is switched over, the volume of air in the inner space 32 in the upper portion of the cylinder 10 can be varied at arbitrary timing, so as to freely change the driving force of the piston 9. It is possible to use, as the pressure source 103, a compressor, a tank reserving compressed air, or the like. For example, the compressor may be used as the pressure source 103 because it is possible to supply a necessary volume of compressed air. In such a configuration provided with the air volume control valve 101, the volume of gas in the gas actuator 30 can be freely controlled even when the gas actuator is in operation, thereby easily dealing with variation of load weight.

An air mass indicator 105 that serves as one example of a gas volume estimator and estimates the volume of gas in the inner space 32 in the upper portion of the cylinder 10. More specifically, the air mass indicator 105 calculates a volume V in the inner space 32 in the upper portion of the cylinder 10 from output of an contactless displacement gauge 106 for measuring displacement of the first slider 4*a* and the sectional area of the piston 9 (more accurately, an area obtained by subtracting the sectional area of the piston rod 9*a* from the area of the piston plate 9*b*). Absolute pressure P in the inner space 32 of the cylinder 10 is measured with use of a pressure gauge 107, and absolute temperature T of air in the inner space 32 of the cylinder 10 is measured with use of a thermometer 108. On the basis of the calculated volume V, the absolute pressure P measured by the pressure gauge 107, and the absolute temperature T of air measured by the thermometer 108, the mass of air is calculated by the air mass indicator 105 in accordance with PV/(RT) (wherein R is a gas constant of air). The mass of air thus calculated is indicated by the air mass indicator 105. In such a configuration, the volume of gas can be accurately controlled with reference to the air mass indicator 105, thus more easily dealing with variation of load weight.

Described next is the operation of the gravity compensation device 1.

Figure 2:
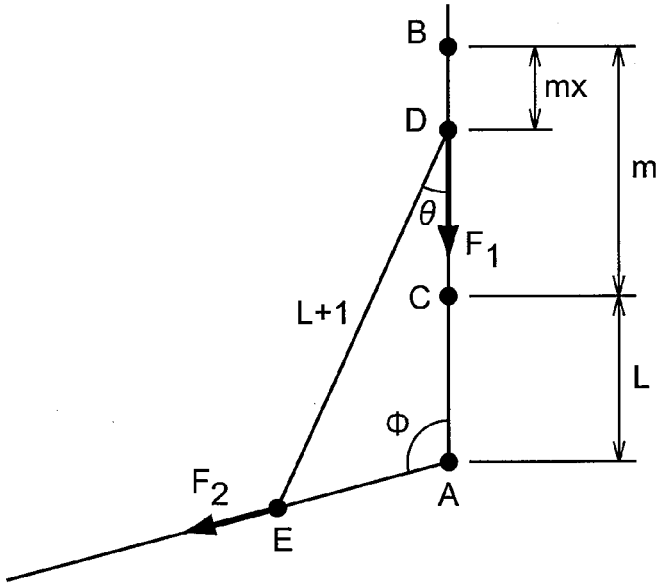
FIG. 2 is a pattern view showing conversion of force in the first embodiment.

FIG. 2 is a pattern view showing conversion of force. In FIG. 2, points D and E correspond to the positions of the first pin 5*a* and the second pin 5*b* at the respective ends of the rod 6. A point C corresponds to the position of the first pin 5*a* at the lower limit in the motion range indicated in FIG. 1. Points A and B correspond respectively to the points A and B indicated in FIG. 1. The point B indicates the position of the first pin 5*a* in a case where the volume of the inner space 32 in the gas actuator 30 is zero, in other words, where the piston 9 is in contact with the upper inner surface of the cylinder 10 in FIG. 1. If the volume of the inner space 32 cannot be set to zero even though the piston 9 is in contact with the upper inner surface of the cylinder 10 because the volume in the piping 102 is too large to be disregarded or the like, the position of the point B in the gas actuator 30 may be set as a virtual point obtained by extrapolating variation of the volume of the inner space 32 in the cylinder 10 in the motion range. In FIG. 2, a length L indicates the distance between the points A and C. A length m indicates the distance between the points B and C. The distance between the points B and D is varied in accordance with the motion of the piston 9 and is indicated by a length mx. In this case, a coefficient x has a value from zero to one, and the points B and D fall on the identical position when x=0 is established. When x=1 is established, the points D and C fall on the identical position and the piston 9 is located at the lower limit in the motion range.

When the piston 9 moves, the coefficient x has a lower limit value that is limited to 0.13, for example, by the upper end stopper pin 16*a* or the like, so as to reduce variation of gravity compensation force as to be described later. In this case, the motion range is expressed as $0.13 \leq x \leq 1$. In FIG. 1, x=0.13 is established when the piston 9 is located at the upper end position UP, while x=1 is established when the piston 9 is located at the lower end position LP. That is, even in the case where the point B is located at a virtual position when x=0 is established, if the position of the piston 9 in contact with the upper inner surface of the cylinder 10 corresponds to a value equal to or less than the lower limit value (0.13, for example) of the coefficient x, there arises no problem in terms of the configuration.

In FIG. 2, the lengths L and m have values normalized such that the distance between the two ends of the rod 6 is expressed as L+1 (the same applies hereinafter). FIG. 1 serves as one example of the case where L=1 and m=1.1 are established.

Described with reference to the pattern view in FIG. 2 is gravity compensation force in the gravity compensation device 1.

When the driving force of the piston 9 is applied to the point D as a force $F_1$ toward the point A, a force $F_2$ in the axial direction of the second guide rail 3*b* is applied to the point E. The ratio in magnitude between the force $F_2$ and the force $F_1$ is expressed as $F_2/F_1=\tan\theta \sin\phi-\cos\phi$, wherein θ is an angle defined by the points C, D, and E, and ϕ is an angle defined by the points E, A, and C (FIG. 1 serves as one example of the case of 90 (degrees)). The value of the coefficient x is expressed as $1-[(L+1)(\cos\theta+\sin\theta/\tan\phi)-L]/m$. When x=1 is established, the angle θ has a maximum value θmax, and satisfies $\cos\theta max+\sin\theta max/\tan\phi=L/(L+1)$. When $\phi\geq 90°$ is established, the angle θ has a minimum value θmin equal to zero. On the other hand, when $\phi<90°$ is established, $\theta min=90°-\phi$ is satisfied. If the angle φ and the length L are determined, it is possible to obtain θmin and θmax. It is possible to obtain the relationship between the coefficient x and $F_2/F_1$ by obtaining $F_2/F_1$ and the coefficient x from each of the values of the angle θ varied in the range from θmin to θmax.

Figure 3:
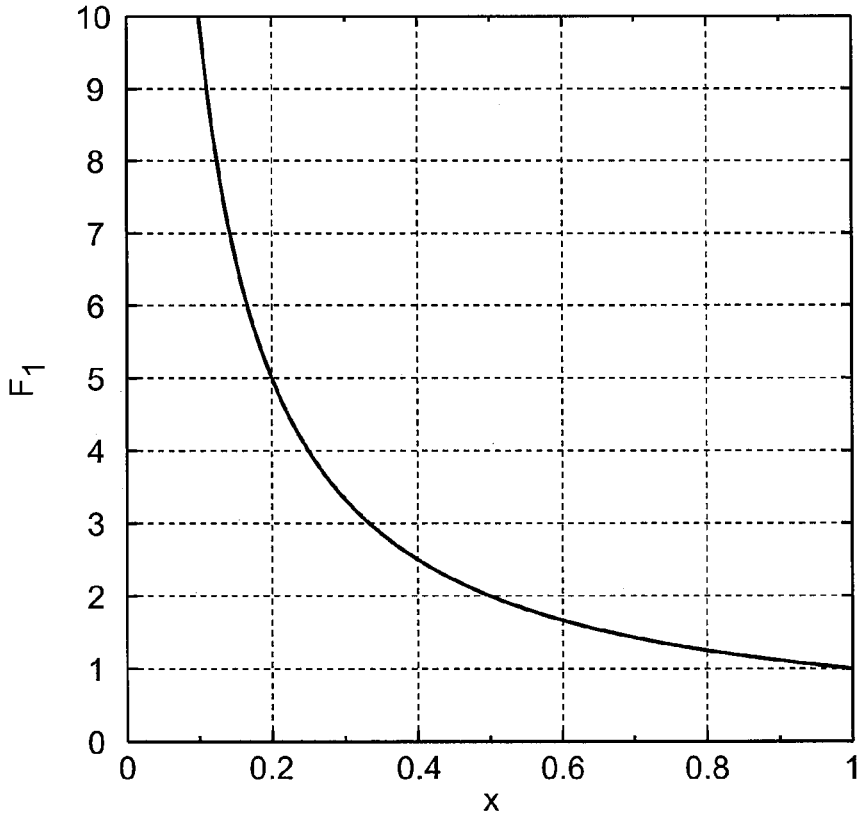
FIG. 3 is a graph indicating the relationship between a variation rate x of a piston and driving force $F_1$ of the piston in the first embodiment.

Described next is the driving force $F_1$ of the piston 9 applied to the point D. FIG. 3 indicates the relationship between a variation rate x of the piston 9 and the driving force $F_1$ of the piston 9 in a case where the volume of air is constant in the inner space 32 in the upper portion of the cylinder 10. Displacement mx of the piston 9 is expressed as a variation rate including the coefficient x, which is a ratio of displacement to m. The same applies to each of the drawings to be referred to later. The direction of displacement of the piston 9 (the axial direction of the piston rod 9*a*) is assumed to be parallel to the axis connecting the points A and B (the axial direction of the first guide rail 3*a*). FIG. 3 indicates the driving force $F_1$ that is normalized so as to be equal to one when x=1 is established. In the present embodiment, the influence of the atmospheric pressure is eliminated. Therefore, the driving force $F_1$ is expressed as 1/x. This will apply similarly to a case where the inner space 32 in the upper portion of the cylinder 10 has high internal pressure (100 atmospheres, for example) and the influence of the atmospheric pressure can be disregarded. As indicated in FIG. 3, when the volume of air is constant, the driving force $F_1$ of the piston 9 is significantly varied relatively to displacement of the piston 9. Therefore, it is apparently difficult to compensate gravity with direct use of the driving force $F_1$ of the piston 9.

Described below is the relationship thus obtained between the coefficient x and the force $F_2$ in the gravity compensation device 1 according to the present embodiment. This relationship indicates force having been converted by the rod 6 in a case where the driving force $F_1$ of the piston 9 is transmitted to the second slider 4*b* in the configuration shown in FIG. 1.

In the present embodiment, a force applied to the lift plate 15 is doubled in terms of displacement, thereby having a half value. The same applies to the following description. As the force $F_2$ has a value closer to a constant value relatively to the coefficient x, it is possible to apply constant force to the lift plate 15, which is effective as the gravity compensation device 1.

Figure 4:
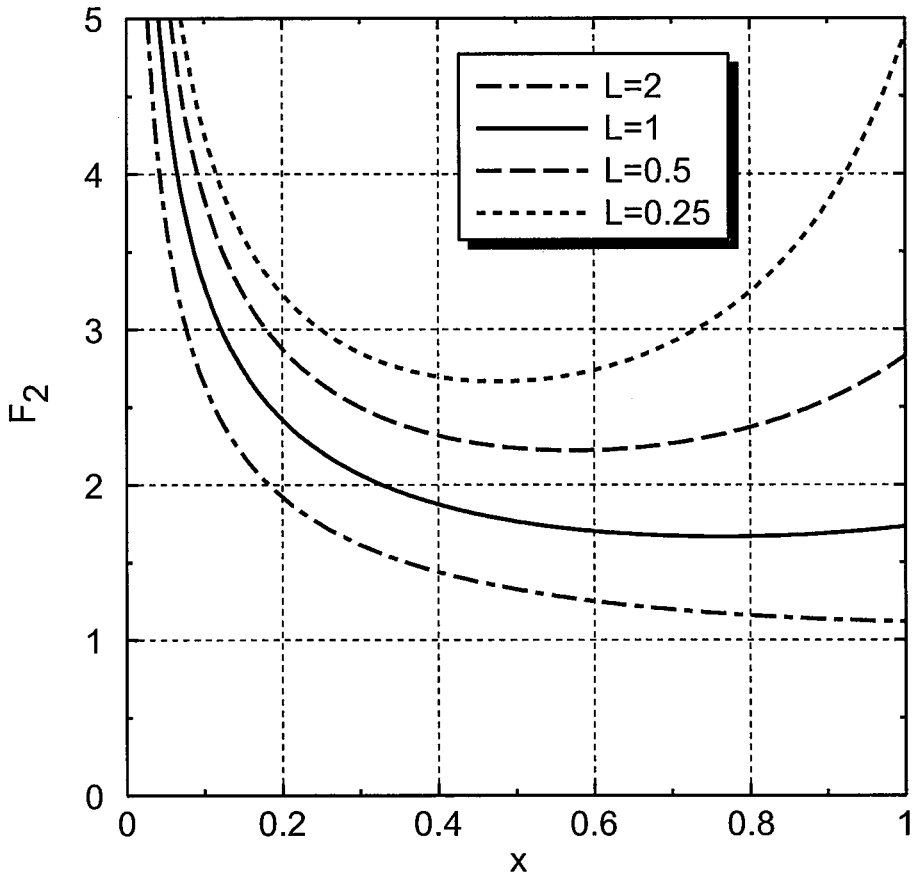
FIG. 4 is a graph indicating that the relationship between the variation rate x of the piston and force $F_2$ having been converted by a link is changed in accordance with a length L in the first embodiment.

FIG. 4 indicates differences in effect when the length L as a design value is varied. In this case, m=1 and φ=90° are established. As apparent from FIG. 4, the property indicated in FIG. 3 is significantly changed due to conversion by the rod 6.

Figure 5:
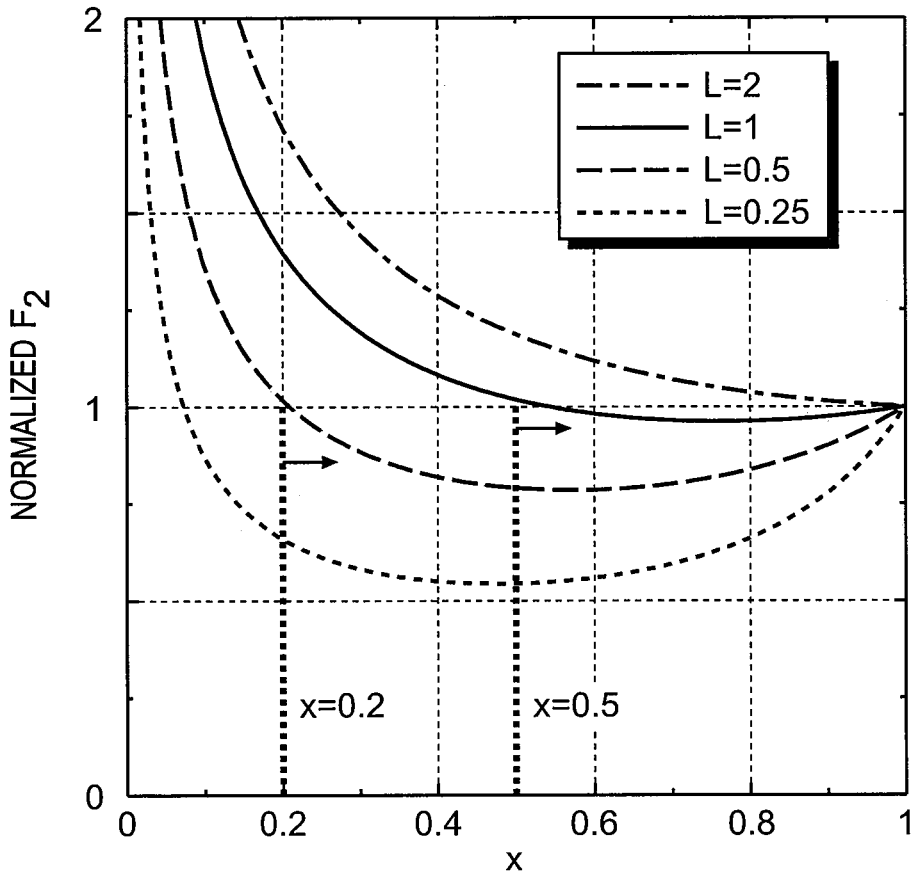
FIG. 5 is a graph indicating that the relationship between the variation rate x of the piston and force having been converted by the link and normalized by force at the maximum variation of the piston (normalized $F_2$) is changed in accordance with the length L in the first embodiment.

FIG. 5 is a graph in which the results indicated in FIG. 4 are normalized by the values in the case of x=1, respectively. As apparent from FIG. 5, variation of force can be reduced by selecting an appropriate value of the length L in accordance with the motion range of the coefficient x. For example, in a case where L=1 is established and the motion range is set by x ranging from 0.5 to 1, force, which is varied so as to be doubled in the property indicated in FIG. 3, can be suppressed to be varied by approximately 0.96 times. Similarly, in a case where L=0.5 is established and the motion range is set by x ranging from 0.2 to 1, force, which is increased by five times in the property indicated in FIG. 3, can be suppressed to be varied by approximately 0.78 times. It is proved that, the larger the lower limit value of the coefficient x to be applied is, the larger the length L may be set. In any case, gravity compensation force can be approximated to be constant rather than the case of directly using the driving force of the piston 9. Therefore, when a constant gravity load is applied to the lift plate 15, it is possible to reduce variation of gravity compensation force in accordance with displacement even with no consumption of gas.

Figure 6:
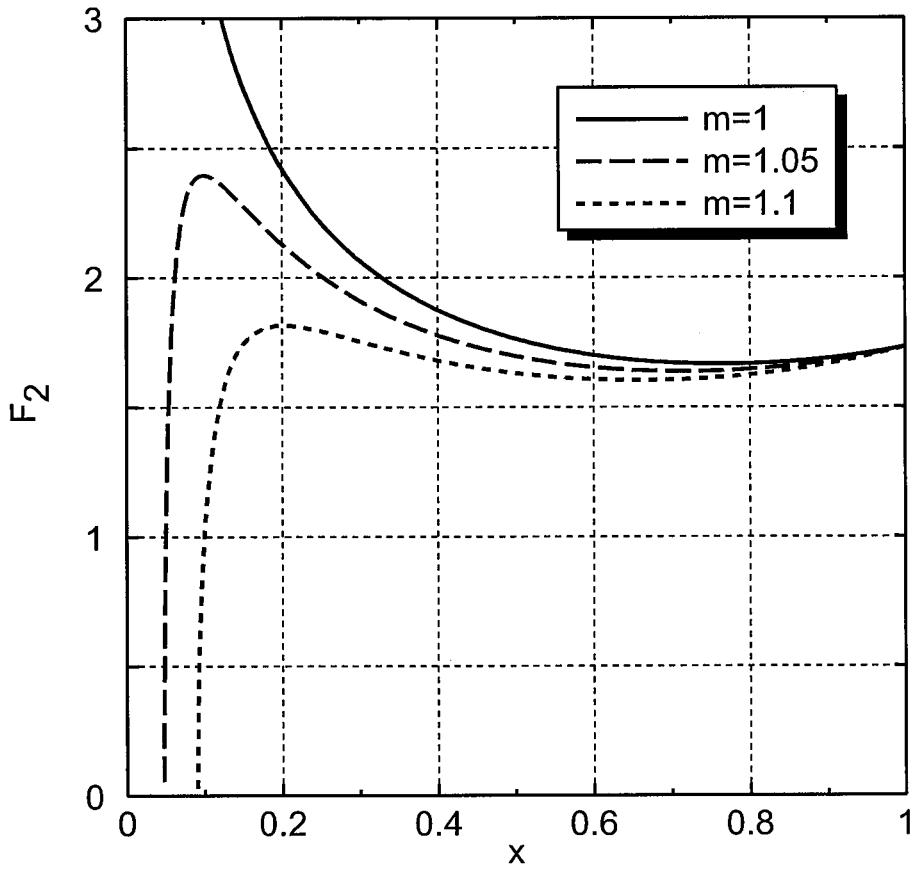
FIG. 6 is a graph indicating that the relationship between the variation rate x of the piston and the force $F_2$ having been converted by the link is changed in accordance with a length m in the first embodiment.

FIG. 6 indicates differences in effect when the length m as a design value is varied. In this case, L=1 and φ=90° are established. As apparent from FIG. 6, the property in the case of m=1 is significantly changed by variation of the length m. However, the value in the case of x=1 is not varied because the length L is constant.

Figure 7:
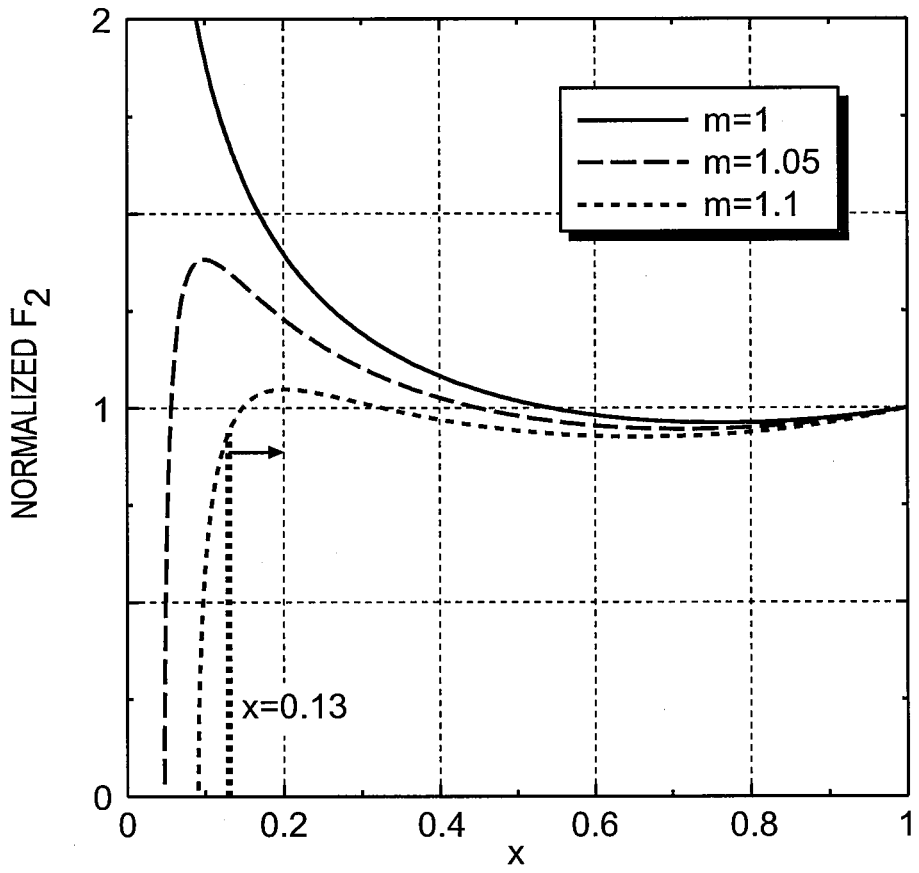
FIG. 7 is a graph indicating that the relationship between the variation rate x of the piston and the force having been converted by the link and normalized by the force at the maximum variation of the piston (normalized $F_2$) is changed in accordance with the length m in the first embodiment.

FIG. 7 is a graph in which the results indicated in FIG. 6 are normalized by the values in the case of x=1, respectively. As apparent from FIG. 7, the range of the coefficient x causing less variation of force can be enhanced by selecting an appropriate value of the length m. For example, in a case where m=1.1 is established and the motion range is set by x ranging from 0.13 to 1, force, which is increased by 7.7 times in the property indicated in FIG. 3, can be suppressed to be varied by approximately 0.92 to 1.05 times. Therefore, when a constant gravity load is applied to the lift plate 15, it is possible to further reduce variation of gravity compensation force in accordance with displacement even with no consumption of gas. In particular, it is desired to set such that L=1, m=1.1, and φ=90° is substantially established, in which case the motion range can be widened as well as variation of gravity compensation force can be reduced.

Figure 8:
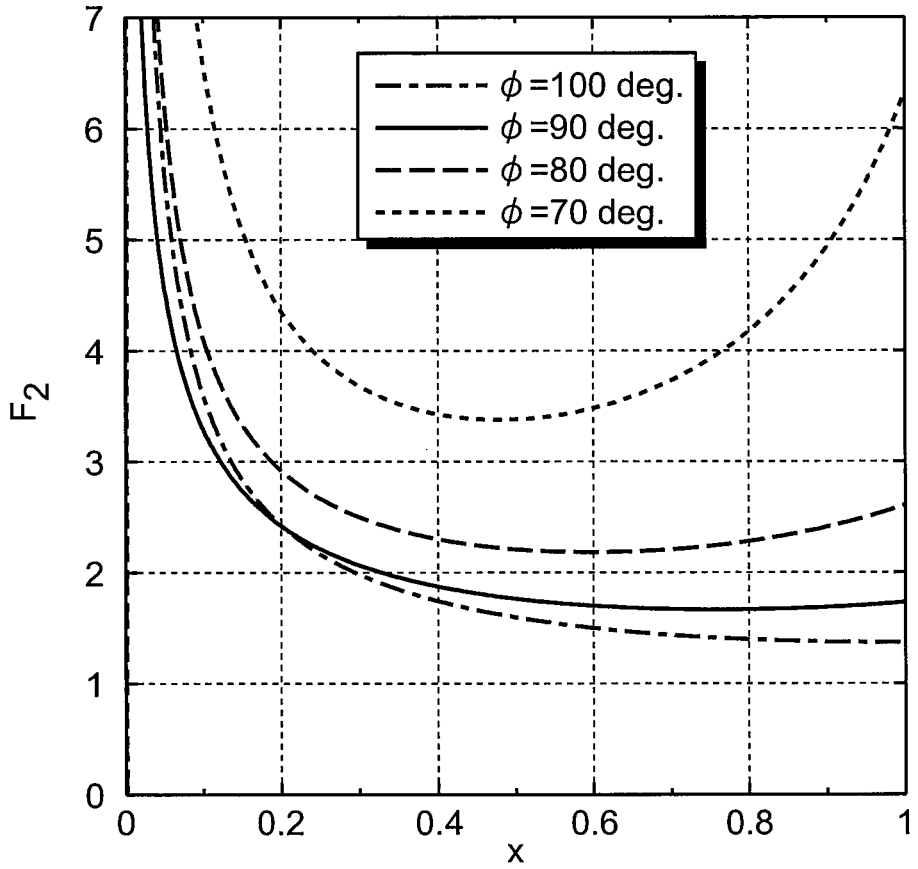
FIG. 8 is a graph indicating that the relationship between the variation rate x of the piston and the force $F_2$ having been converted by the link is changed in accordance with an angle $\phi$ in the first embodiment.

FIG. 8 indicates differences in effect when the angle φ as a design value is varied. In this case, L=1 and m=1 are established. As apparent from FIG. 8, the property in the case of φ=90° is significantly changed by variation of the angle φ.

Figure 9:
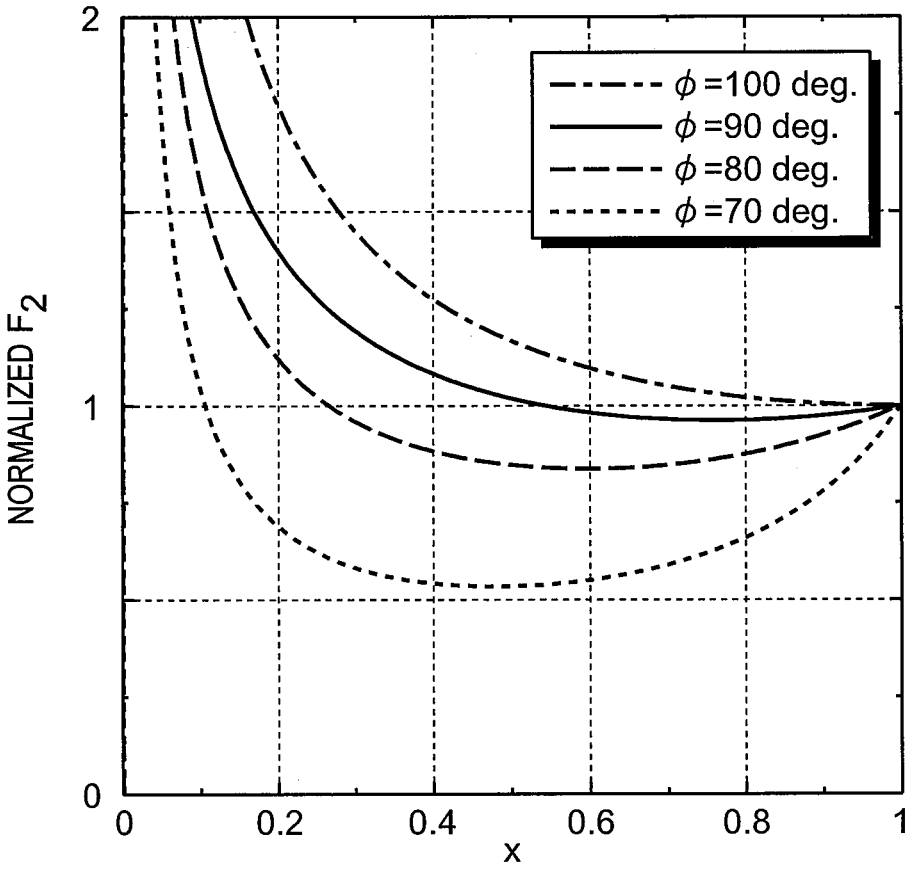
FIG. 9 is a graph indicating that the relationship between the variation rate x of the piston and the force having been converted by the link and normalized by the force at the maximum variation of the piston (normalized $F_2$) is changed in accordance with the angle $\phi$ in the first embodiment.

Similarly, FIG. 9 is a graph in which the results indicated in FIG. 8 are normalized by the values in the case of x=1, respectively. As apparent from the results indicated in FIGS. 8 and 9, also in the case where the angle φ is varied, it is possible to obtain results similar to those of the case where the length L is varied. Therefore, in addition to the case where the angle φ has a value equal to 90°, when a constant gravity load is applied to the lift plate 15, it is possible to reduce variation of gravity compensation force in accordance with displacement even with no consumption of gas.

The force having been converted is in proportion in magnitude to the driving force of the piston 9 indicated in FIG. 3. More specifically, pressure is doubled when the mass of air in the inner space 32 in the upper portion of the cylinder 10 is doubled, with a result that the force having been converted can be doubled in magnitude. Thus, by controlling the mass of air with use of the air volume control valve 101, it is possible to easily vary gravity compensation force even in a case where load weight is varied. In this case, the mass of air can be easily controlled with reference to the mass of air indicated by the air mass indicator 105. The mass of air can be controlled manually or automatically. In the latter case, a control system for operating the air volume control valve 101 may be structured such that a value indicated by the air mass indicator 105 reaches a desired value. Gravity compensation force can be also controlled in order to obtain absolutely constant gravity compensation force. Also in this case, gravity compensation force can be controlled with consumption of air of a less volume, because variation of gravity compensation force in accordance with displacement is smaller as compared with a conventional case of controlling pressure of an air cylinder. The effect thereof is more remarkable as the motion range set by the coefficient x is wider.

Figure 10:
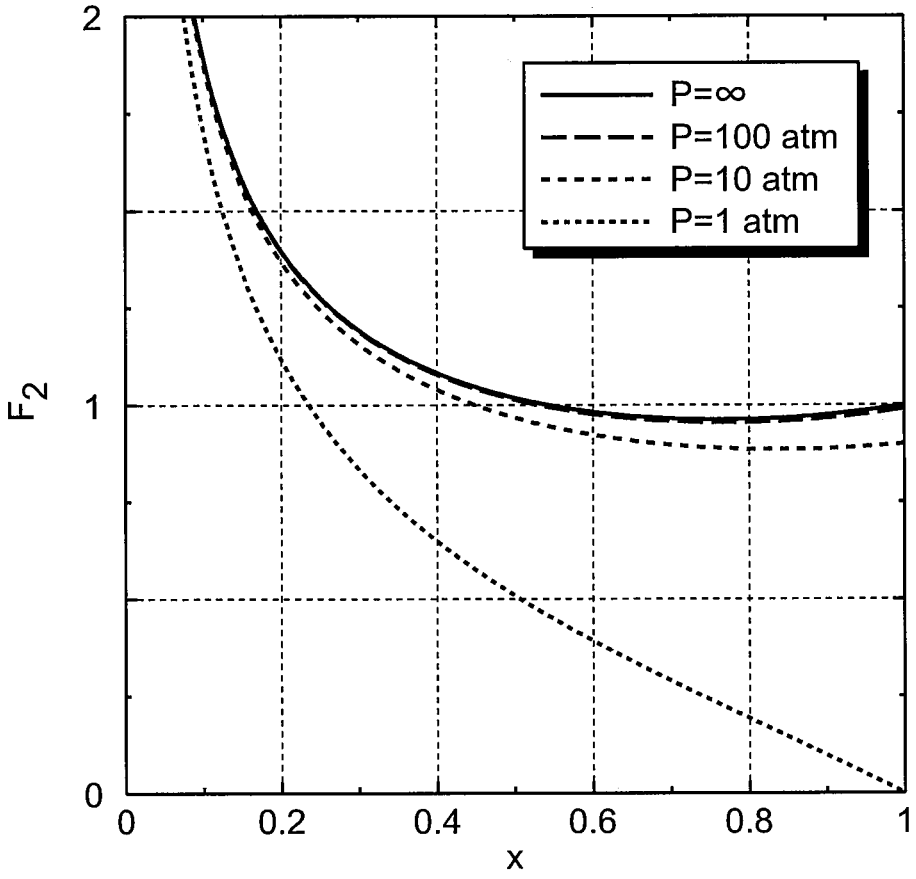
FIG. 10 is a graph indicating difference in tolerance caused by pressure at the maximum variation of the piston in the relationship between the variation rate x of the piston and the force $F_2$ having been converted by the link in the first embodiment.

FIG. 10 indicates how gravity compensation force is varied by the absolute pressure P in the case of x=1 when the weight 8 is not provided, in order to prove the effect of the weight 8. This case satisfies L=1, m=1, and $\phi$=90°. The case of P=∞ corresponds to the case where the weight 8 is provided. As apparent from FIG. 10, without the weight 8, when the absolute pressure P in the case of x=1 is less than 10 atmospheres, gravity compensation force is significantly varied. On the other hand, when the absolute pressure P in the case of x=1 is more than 100 atmospheres, there is almost no influence even without the weight 8. Therefore, it is possible to embody both the structure in which the atmospheric pressure compensation portion such as the weight 8 is not provided by operating at high pressure, and the structure in which the atmospheric pressure compensation portion such as the weight 8 is provided so as to compensate gravity with no tolerance even at low pressure.

In the configuration according to the above embodiment, force generated by the gas actuator 30 from internal pressure is transmitted to the lift section 15 by way of the rod 6 having the two ends restrained so as to be axially shiftable by the first and second guide rails 3*a* and 3*b* serving as one example of the two shafts, respectively. Therefore, it is possible to reduce the influence of variation of generated force in accordance with displacement of the gas actuator 30 on force applied to the lift section 15. In other words, according to the above embodiment, it is possible to compensate gravity even when the lift section is displaced, with a constant volume of gas in the gas actuator. Therefore, it is possible to achieve the gravity compensation device that can easily deal with variation of load weight by controlling the volume of gas in the gas actuator 30 and does not need to consume gas upon displacement of the lift section 15. If the gas actuator 30 is configured by the piston/cylinder mechanism, it is possible to easily obtain the relationship between displacement of the gas actuator 30 and internal pressure, thereby achieving the gravity compensation device with less tolerance.

In the present embodiment, each of the guide rails is combined with the corresponding slider in order to restrain the slider so as to be axially shiftable. However, the present disclosure is not limited to such a case. Alternatively, it is possible to apply any combination of known techniques as long as realizing a similar function, such as a ball spline.

In the present embodiment, the piston/cylinder mechanism is adopted as the gas actuator 30. However, the present disclosure is not limited to such a case. Alternatively, it is possible to embody any mechanism as long as the volume of the inner space 32 is in proportion to the displacement of the first slider 4*a*, such as a rack and pinion mechanism that converts rotation outputted from a vane motor to linear motion.

The present embodiment adopts air as gas used to operate the gas actuator 30. However, the present disclosure is not limited to such a case. Alternatively, it is possible to uses any type of gas that can be regarded as ideal gaseous matter. Air is desired because it is possible to obtain easily. Inert gas such as nitrogen is also desired because nitrogen has stable properties. Depending on the type of gas, the pressure source 103 may generate gas by chemical reaction or evaporate liquid gas to generate compressed gas. The atmosphere releasing outlet 104 may not be necessarily configured to release gas into the atmosphere. Alternatively, the atmosphere releasing outlet may be configured to discharge gas into a collecting tank.

In the present embodiment, the mass of air is obtained by the gas volume estimator. However, the present disclosure is not limited to such a case. There may be alternatively used any value having proportional relationship, such as the number of molecules of air. Still alternatively, there may be used a value converted to gravity compensation force in accordance with the pattern view in FIG. 2. Furthermore, measurement of displacement for calculation of the volume V in the cylinder is not necessarily performed with use of the first slider 4*a*. Alternatively, any displacement may be measured with use of any member that operates in association. Displacement may not be necessarily measured by the contactless displacement gauge, but may be measured by any gauge such as a contact displacement gauge. Moreover, for measurement of the absolute temperature T, temperature of air in the inner space 32 in the upper portion of the cylinder 10 may not be necessarily measured directly. Alternatively, temperature of the atmosphere may be measured, or a constant value may be provided as the temperature of air.

In the present embodiment, the weight 8 is used as the atmospheric pressure compensation portion. However, the present disclosure is not limited to such a case. Alternatively, the piston 9 and the frame 2 may be coupled by means of a constant force spring. According to such a configuration, the atmospheric pressure may be compensated in a simple structure.

Still alternatively, the influence of the atmospheric pressure may be eliminated actively with use of an actuator, instead of adopting a passive measure such as a weight or a constant force spring. The influence of the atmospheric pressure may be eliminated by sealing the lower surface of the cylinder 10 and additionally providing a substantially evacuated space surrounded by the piston 9 and the cylinder 10. More specifically, when the space in which differential pressure relative to the inner space 32 of the gas actuator 30 is in proportion to force generated by the gas actuator 30 (the space under the piston plate 9*b*) has substantially vacuum pressure, the influence of the atmospheric pressure can be cancelled. As a result, gravity can be compensated with no tolerance even in a case of being operated at low pressure.

The present embodiment adopts the stopper pins 16*a* and 16*b* for limiting the motion range of the piston 9. However, the present disclosure is not limited to such a case. Alternatively, the shiftable range of the piston 9 in the inner space 32 in the upper portion of the cylinder 10 may be set to be identical with the motion range. Still alternatively, the motion range of the slider 4*b* may be limited so as to limit the motion range of the piston 9.

The present embodiment adopts the lift plate 15 in the plate shape as the lift section. However, the present disclosure is not limited to such a case. The lift section may be alternatively embodied by any member in any shape, such as a forked member, or a bar member provided along the vertical axis of the third guide rail 3*c*.

The coupling section 31 in the present embodiment is configured by the wire and the pulley transmission system. However, the present disclosure is not limited to such a case. Alternatively, it is possible to use, as the coupling section 31, any combination of any known techniques such as a link and hydraulic pressure. Furthermore, the transmission gear ratio in such a case is not limited to doubling displacement as in the present embodiment, but the present disclosure can be embodied at any transmission gear ratio.

Figure 11:
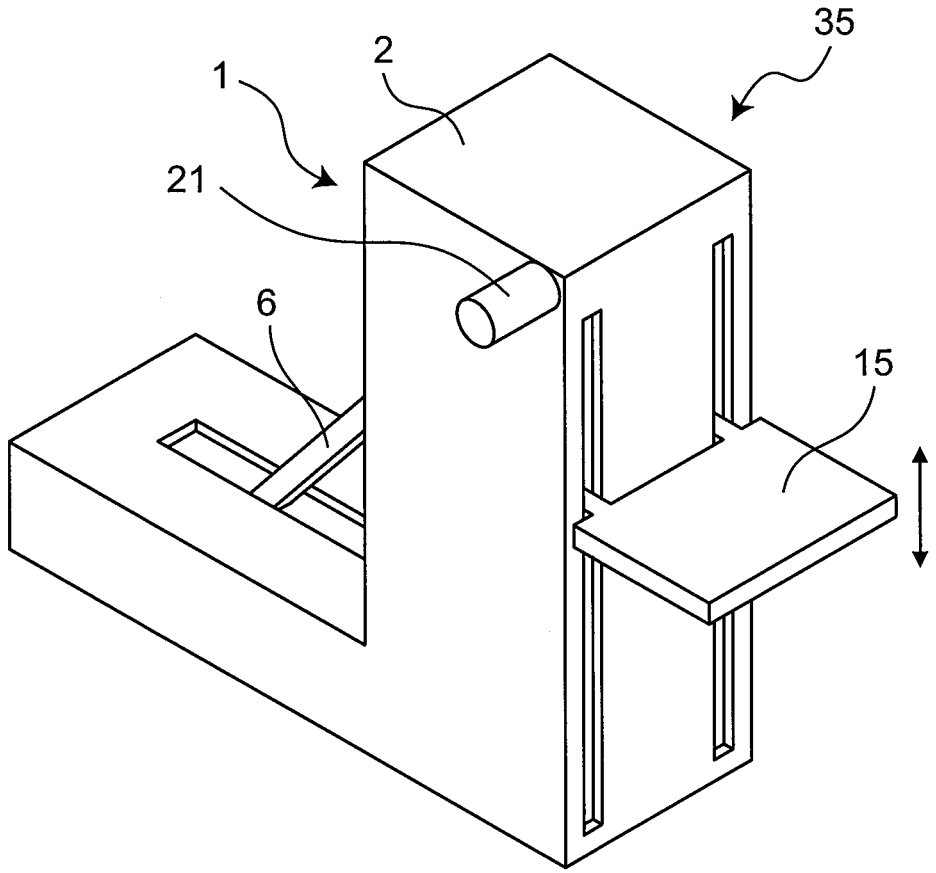
FIG. 11 is a schematic perspective view of a lift apparatus including the gravity compensation device according to the first embodiment.

FIG. 11 serves as one example of a configuration of a lift apparatus 35 including the gravity compensation device 1 according to the first embodiment.

The lift apparatus 35 shown in FIG. 11 is configured by the gravity compensation device 1 and an additional motor 21 serving as one example of a vertical drive unit. When the pulley 12*b* is rotated by the motor 21, the lift plate 15 can be shifted vertically. The second pulley 12*b* and the second wire 11*b* are formed in a sprocket shape and a chain shape, respectively, in order to prevent slipping. In this case, there are provided the third guide rails 3*c* in a pair, which support the lift plate 15 so as to be vertically shiftable.

In this configuration, the lift plate 15 can be vertically shifted by the motor 21 in a state where a gravity load applied to the lift plate 15 is supported by the gravity compensation device 1. As a result, the motor 21 can cause the lift plate 15 to be vertically shifted with less energy.

There is achieved the lift apparatus configured as described above, keeping the features of the gravity compensation device 1 that the volume of gas in the gas actuator 30 is controlled so as to easily deal with variation of load weight and consumption of gas is not required upon displacement of the lift section. In addition, this lift apparatus can vertically shift an object with less energy.

The lift apparatus is not necessarily configured by including the motor as the vertical drive unit. Alternatively, the lift apparatus may be configured by any combination of any known techniques such as any other actuator or a manual operation system, as long as similar functions are realized.

Though the present invention has been described above based on the above first embodiment and modifications, the present invention should not be limited to the above-described first embodiment and modifications.

Any of the various embodiments and modification examples having been described may be appropriately combined to achieve the respective effects thereof.

The gravity compensation device and the lift apparatus including the same according to each one of the aspects of the present disclosure are useful in that variation of load weight can be easily dealt with by controlling the volume of gas in the gas actuator and that consumption of gas is not required upon displacement of the lift section. The gravity compensation device is applicable not only to the lift apparatus but also to an actuator for motion along a vertical axis such as a vertical axis in an industrial robot.

The entire disclosure of Japanese Patent Application No. 2011-124307 filed on Jun. 2, 2011, including specification, claims, drawings, and summary are incorporated herein by reference in its entirety.

Although the present invention has been fully described in connection with the embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A gravity compensation device comprising:

a base having an L-shaped form;

a first guide rail and a second guide rail located on an ordinate axis in a vertical direction and on a transverse axis in a horizontal direction, respectively, the first guide rail and the second guide rail being fixed to the frame such that the ordinate axis and the transverse axis cross each other, the ordinate axis and the transverse axis including a first reference point located at an elbow of the base;

a rod having a first end axially shiftably coupled to the first guide rail and a second end axially shiftably coupled to the second guide rail;

a gas actuator including a cylinder and a piston connected to the first end of the rod, the piston being movable so as to press the first end of the rod from a first end position to a second end position toward the first reference point by pressure of gas in an inner space defined by the piston and an inner surface of the cylinder, the cylinder being fixed to the base so that, when the piston comes into contact with an upper portion of the inner surface of the cylinder, the inner space has essentially no volume and the first end of the rod is located at a second reference point on the first guide rail, the gas actuator being configured so that a motion range of the piston is defined such that a distance between the first reference point and the second reference point is substantially equal to or greater than a distance between the first end and the second end of the rod;

a lift section configured to be vertically shiftable with respect to the base along a third guide rail fixed to the frame, such that the third guide rail is oriented in the vertical direction and parallel to the first guide rail; and a coupling section coupling the second end of the rod and the lift section so as to associate expansion of the inner space of the gas actuator with an upward shift of the lift section, wherein the gravity compensation device compensates for gravity applied to the lift section.

2. The gravity compensation device according to claim 1, further comprising a gas volume controller configured to control a gas volume in the gas actuator.

3. The gravity compensation device according to claim 2, further comprising a gas volume estimator configured to control estimates the gas volume in the gas actuator.

4. The gravity compensation device according to claim 1, further comprising an atmospheric pressure compensation portion configured to compensate for an influence of an ambient atmospheric pressure on a pressing force with the ambient atmospheric pressure being applied to the gas actuator.

5. The gravity compensation device according to claim 4, wherein the atmospheric pressure compensation portion is a weight connected to the piston of the gas actuator.

6. The gravity compensation device according to claim 1, wherein a force proportional to a differential pressure, between a pressure in a space in a lower portion of the cylinder below the piston and a pressure in the inner space, is applied to the piston.

7. A lift apparatus comprising:

The gravity compensation device according to claim 1; and a vertical drive unit configured to vertically shift the lift section of the gravity compensation device.

* * * * *